United States Patent [19]

Lönnstedt

[11] 4,391,000

[45] Jul. 5, 1983

[54] EAR MUFF MOUNTING DEVICE

[76] Inventor: Bo G. Lönnstedt, Kvarnbergsvägen 23, S-141 45 Huddinge, Sweden

[21] Appl. No.: 356,397

[22] Filed: Mar. 9, 1982

[51] Int. Cl.[3] ..... A42B 3/00; A42B 1/06

[52] U.S. Cl. ..... 2/423; 2/209; 179/156 R

[58] Field of Search ..... 2/209, 423, 6, 422, 2/10; 179/156 R

[56] References Cited

U.S. PATENT DOCUMENTS

| | | | |
|---|---|---|---|
| 3,273,163 | 9/1966 | Andrew | 2/422 |
| 4,167,043 | 9/1979 | Hartig | 179/156 R X |
| 4,287,614 | 9/1981 | Lonnstedt | 2/423 |

*Primary Examiner*—Peter P. Nerbun

*Attorney, Agent, or Firm*—Young & Thompson

[57] ABSTRACT

Hard hats are often provided with ear muffs, which are mounted by removable fittings. The hat is provided with two narrow pockets for receiving these fittings. Each fitting comprises a main body, where the ear muff holder arm is rotatably secured, and a plate member for insertion into a pocket. The plate member is arranged at an angle to the main body to ensure a certain clamping, when forced into the pocket. To hold the fitting the plate member is, at its lower edge, provided with a transverse ledge, which snaps in below the bottom edge of the pocket. To accommodate the fitting in pockets of various depths there is a ledge means above the ledge, said ledge means being shorter and less wide than the ledge.

4 Claims, 5 Drawing Figures

FIG. 1
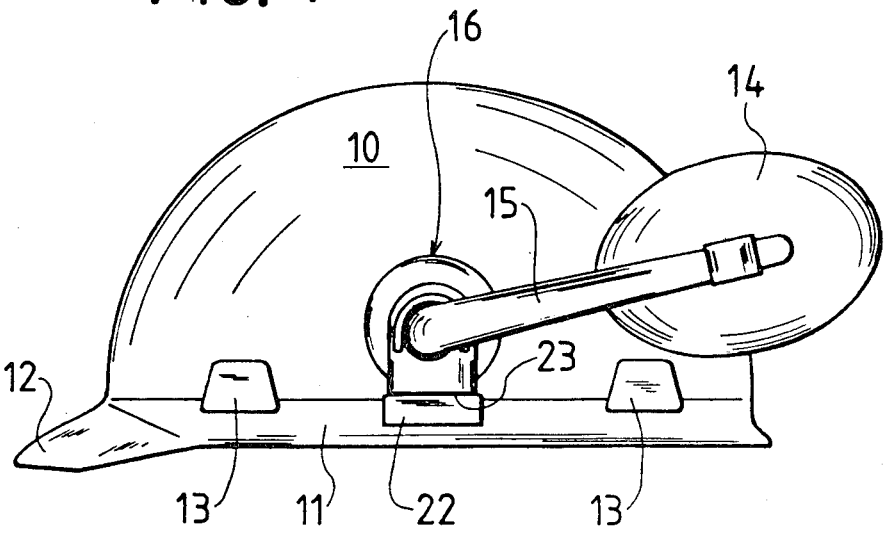
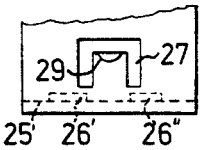
FIG. 5
FIG. 2
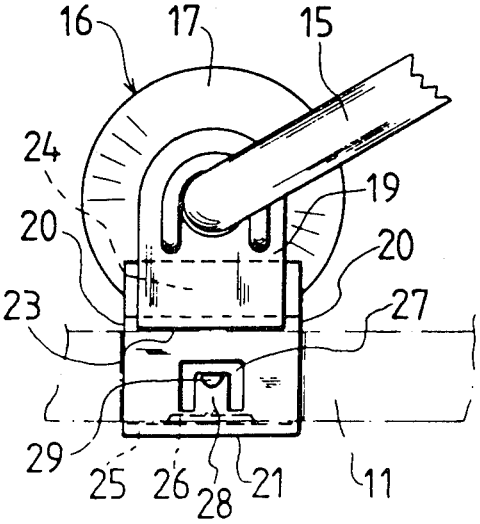
FIG. 3
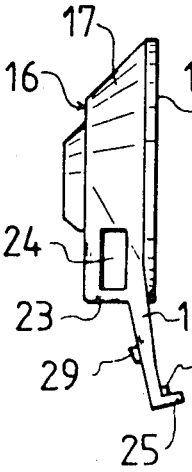
FIG. 4
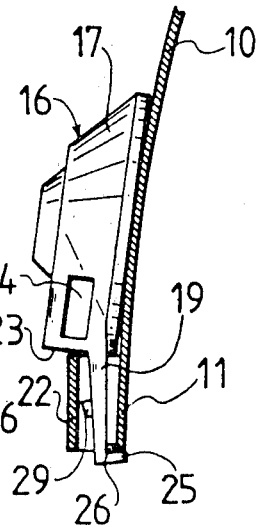

EAR MUFF MOUNTING DEVICE

BACKGROUND OF THE INVENTION

Protective helmets, so-called hard hats, are often provided with ear muffs. These are mounted in fittings, which permit the wearer of the hat to locate the muffs over his ears, or to swing the muffs up towards the crown of the hat, when they are not needed.

The fittings may be permanently attached to the hat, but they are mostly removable. The hat is then, along its rim and in positions above the ears of the wearer, provided with narrow pockets, into which the fittings are inserted. The size of these pockets may vary slightly from manufacturer to manufacturer, and acceptable tolerances will also mean variations in dimensions.

The swinging of the ear muffs to and from active position will impose a load upon the fittings, and it is necessary that they are securely retained in their pockets.

The aim of the present invention is to design a fitting in such a manner that it will be satisfactorily kept in pockets of varying size.

SUMMARY OF THE INVENTION

The invention thus refers to a device for removably mounting an ear muff holder arm at a hard hat having a narrow pocket defined by substantially parallel side walls and having an open bottom. The device comprises a main body for rotatably receiving the holder arm, and is defined by a face adapted to rest against the crown of the hat. A plate member having a shape suitable for fitting into said pocket projects from the main body, and has an inward face to be directed towards the hat and arranged at an angle less than 180° in relation to the face of the main body. The plate member has substantially parallel side edges and a transverse lower edge. A ledge extends across the plate member and faces the same way as the inward face, and a ledge means, being narrower and shorter than said ledge, is located above and parallel to the latter.

To further promote the retention a U-formed slot is formed in the plate member, and a resilient tongue extends into this U-shaped slot in a direction away from the lower edge. The tongue is at its free end provided with a projection directed away from the inward face.

BRIEF DESCRIPTION OF THE DRAWING

FIG. 1 shows a side view of a hard hat with an ear muff swung to in-active position, FIG. 2 shows a side view of the fitting FIG. 3 shows an end view of the fitting removed from the hat, FIG. 4 shows the fitting mounted at the hat, and FIG. 5 shows a detail of a slightly different embodiment than the one shown in FIG. 2.

BRIEF DESCRIPTION OF A PREFERRED EMBODIMENT

FIG. 1 shows a side view of a hard hat having a crown 10 and a lower rim 11 as well as a front peak 12. The hat is of conventional type, pressed from plastics material and possibly reinforced in suitable manner. To carry internal supporting bands (not shown) there are a number of wharts 13 along the rim of the hat.

An ear muff is generally denoted by 14, and is mounted upon an arm 15, which is rotatably mounted in a fitting 16. The arm 15 has sufficient length to permit the muff being swung down to cover the ear of the wearer of the hat. The mounting of the muff upon the arm permits an adjustment of the efficient length of the arm.

The fitting comprises a main body 17, having suitable journal means for the arm 15 and having a generally flat face 18, which is to be turned towards and rest against the crown of the hat.

A plate member 19 projects from the main body, and is defined by generally parallel side edges 20 and a lower edge 21. The plate member is dimensioned to fit into a pocket 22 provided in a suitable position along the rim of the hat—there of course being two such pockets.

Even if there is no official standardization of the size of these pockets, there is a general endeavour to hold about the same size. Manufacturing tolerances will however bring about differences, which make it difficult to ensure a stable retention of the fitting.

To ensure a basic clamping the plate member 19 is (FIG. 3) oriented at an angle to the main body. The lower portion of the body is formed as a shoulder 23, which is to rest on top of the pocket 22. In the present embodiment said lower portion is formed with a passage 24, into which a further fitting (not shown) for a visor may be fitted.

At the lower edge 21 of the plate member 19 there is a sturdy ledge 25, which in use is intended to snap in below the lower edge of the pocket 22. This ledge extends the full width of the plate member and it will in cooperation with the lower edge of the pocket, not only retain the fitting in the pocket, but also, together with the shoulder 23, prevent rocking movements.

It may happen that some pockets have lesser depth than the majority, and to meet such contingency there is on the plate member a ledge means 26 above the ledge 25. The ledge means 26 is not as deep as the ledge, and it does not extend over the full width of the plate member.

In a shallow pocket this ledge means will cooperate with the bottom edge of the pocket in the same manner as described above. The fact that it is shorter than the breadth of the plate member will aid in holding the fitting "upright" in such a pocket.

Said ledge means 26 may be continuous, as shown in FIG. 2, or may comprise two portions 26′ and 26″ located some distance apart, as shown in FIG. 5.

To further promote the retention there is a U-shaped slot 27 in the plate member. A resilient tongue 28 projects into this slot, away from the lower edge and is, at its free end provided with a projection 29, directed away from the ledge 25.

When the fitting 16 is pushed into the pocket 22, the basically angular position of the plate member 19 in relation to the main body will impose a resilient force against one longitudinal wall of the pocket, while the projection 29 presses against the opposite longitudinal wall.

What I claim is:

1. A device for removably mounting an ear muff holder arm at a hard hat having a narrow pocket defined by substantially parallel side walls and having an open bottom, said device comprising a main body for rotatably receiving said holder arm and defined by a face adapted to rest against said hat, as well as a plate member having a shape suitable for fitting into said pocket, said plate member having an inward face to be directed towards said hat and being arranged at an angle less than 180° in relation to said face of said main body, as well as by substantially parallel side edges and a transverse lower edge, there being provided at said lower edge a ledge extending between said side edges and facing the same way as said inward face, there also being provided a ledge means, being narrower and shorter than said ledge, and being located above and parallel to the latter.

2. A device according to claim 1, in which a U-formed slot is formed in said plate member, and a resilient tongue extends into said U-shaped slot in a direction away from said lower edge, said tongue being at its end remote from said lower edge provided with a projection directed away from said inward face.

3. A device according to claim 1, in which said ledge means is continuous.

4. A device according to claim 1, in which said ledge means comprises two portions, located some distance apart.

* * * * *